US006390602B1

(12) United States Patent
Katakura et al.

(10) Patent No.: US 6,390,602 B1
(45) **Date of Patent: *May 21, 2002**

(54) RECORDING HEAD HAVING A FLEXIBLE CABLE WITH A WINDOW IN WHICH A DRIVE SIGNAL GENERATING SEMICONDUCTOR DEVICE IS PROVIDED

(75) Inventors: Takahiro Katakura; Minoru Usui; Munehide Kanaya, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/879,264

(22) Filed: Jun. 19, 1997

(30) Foreign Application Priority Data

Jun. 19, 1996 (JP) ..... 8-178449

(51) Int. Cl.[7] ..... B41J 2/14; B41J 2/16
(52) U.S. Cl. ..... 347/50
(58) Field of Search ..... 347/50, 57, 71, 347/70; 439/67; 361/749

(56) References Cited

U.S. PATENT DOCUMENTS

| | | | | |
|---|---|---|---|---|
| 4,764,659 A | | 8/1988 | Minami et al. | 219/216 |
| 5,648,804 A | * | 7/1997 | Keefe et al. | 347/50 |
| 5,956,060 A | * | 9/1999 | Zaba et al. | 347/50 |
| 5,971,525 A | * | 10/1999 | Inoue et al. | 347/50 |
| 6,003,974 A | * | 12/1999 | Wilson et al. | 347/50 |
| 6,053,598 A | * | 4/2000 | Inpyn | 347/50 |

FOREIGN PATENT DOCUMENTS

| | | | |
|---|---|---|---|
| EP | 0 388 073 | 9/1990 | B41J/2/05 |
| EP | 0 512 799 | 11/1992 | B41J/2/155 |
| EP | 0 677 388 | 10/1995 | B41J/2/155 |
| EP | 0 773 108 | 5/1997 | B41J/2/145 |
| JP | 6-13724 | 1/1994 | H05K/1/11 |

OTHER PUBLICATIONS

Patent Abstracts of Japan vol. 005, No. 135 (M–085), Aug. 27, 1981 & JP 56 069186 A (Nippon Telegr & Teleph Corp) Jun. 10, 1981 *Abstract.

* cited by examiner

*Primary Examiner*—Benjamin R. Fuller
*Assistant Examiner*—C Dickens
(74) *Attorney, Agent, or Firm*—Sughrue Mion, PLLC

(57) ABSTRACT

An ink jet recording head comprises: recording head units arranged linearly, each of the plurality of recording head units having a pressure producing chamber communicating with a nozzle opening, piezoelectric element for applying pressure to the pressure producing chamber, and a connecting terminal for supplying a drive signal to the piezoelectric element; a drive signal generating semiconductor device for generating the drive signal for driving the piezoelectric element based on a print signal; and a flexible cable for supplying the print signal from an external circuit to the drive signal generating semiconductor device, and supplying the drive signal to the piezoelectric element while connected to the connecting terminal, wherein the flexible cable has a widow and a conductive path, the window allowing the drive signal generating semiconductor device to be attached thereto, and the conductive path being formed so as to extend substantially in parallel in a direction of arrangement of the recording head units and being exposed at a window region in such a manner that a metal foil forming the conductive path traverses the window and suspends on the lower surface of the semiconductor device.

27 Claims, 10 Drawing Sheets

RECORDING HEAD HAVING A FLEXIBLE CABLE WITH A WINDOW IN WHICH A DRIVE SIGNAL GENERATING SEMICONDUCTOR DEVICE IS PROVIDED

BACKGROUND OF THE INVENTION

The present invention relates to a head for a printing apparatus such as an ink jet printer in which a plurality of head units are arranged longitudinal, each head unit having pressure producing means in part of a region occupied by a pressure producing chamber that communicates with a nozzle opening, and producing an ink droplet by applying pressure to ink in the pressure producing chamber. More specifically, the present invention relates to a wiring structure for supplying drive signals to the respective head units.

In order to meet the needs for high-speed printing and high-density printing, the number of nozzle openings per recording head is increased. Handling a fluid such as ink, the ink jet recording head is sensitively affected by inconsistency in the fluid resistance or the like of passages such as nozzle openings and pressure producing chambers, and therefore requires uniformity and high accuracy in forming a great number of nozzle openings and pressure producing chambers. In addition, if inconvenience occurs in even only one of members such as a passage or a pressure producing means, print quality is impaired to a great degree, which in turn makes the recording head no use and hence imposes the problem of an extremely low production yield.

In order to overcome this problem, a plurality of recording head units, each having a relatively small number of pressure producing means, are assembled into a recording head in a row. According to this recording head, production yield is improved in compensation for the small number of pressure producing means. As a result, a recording head having a great number of nozzle openings with high production yield can be fabricated.

On the other hand, a drive signal that jets an ink droplet out of a nozzle opening by applying pressure to the ink in a pressure producing chamber of a recording head is supplied through a flexible cable from an external drive circuit. This design requires that at least signal lines equivalent to the number of nozzle openings be provided on the flexible cable. If the number of nozzle openings is increased, a tradeoff between narrow width design for a single signal line and wide width design for a flexible cable must be considered in order to prevent signal attenuation caused by transmission passage resistance.

From the former design arises a problem that a signal attenuate and a time delay in applying pressure to the ink in the pressure producing chamber occurs due to an increase in the resistance and capacitance of the signal line. Further, from the latter design arises a problem that connection between the flexible cable and the recording head becomes difficult because of a large difference in size between the flexible cable and the recording head.

Developed to overcome such problems is a technique, in which a drive signal generating semiconductor integrated device is arranged on the flexible cable. That is, drive signals for applying pressure to the ink in the respective pressure producing chambers is not sent from the external drive circuit, and the print data is fed and the drive signal generating semiconductor integrated device on the flexible cable generates the drive signals. This technique is advantageous in that the drive signals for applying pressure to the ink in the respective pressure producing chambers can be supplied with an extremely small number of signal lines compared with the number of nozzle openings.

Such drive signal generating semiconductor integrated device is arranged on the flexible cable in the following manner. A window, which is a through hole slightly larger than the outer periphery of the semiconductor integrated device, is formed in the flexible cable; tabs are formed by exposing a copper foil inside the window, the copper foil forming a conductive pattern of the flexible cable; and the tabs are soldered to the terminals.

This technique would be very advantageous if drive signals for applying pressure to the ink in all the pressure producing chambers could be generated by a single semiconductor integrated device. However, the number of terminals arranged on the semiconductor integrated device must be equal to that of nozzle openings in order to supply signals to the pressure applying means of the respective pressure producing chambers. Therefore, if the number of nozzle openings amounts to as many as hundreds, the size of a case for containing the semiconductor integrated device must be increased in order to accommodate such number of terminals, which in turn imposes a problem that the semiconductor integrated device becomes unreasonably large in structure. In addition to this problem, there exist not only a problem that the patterns for supplying signals to the respective pressure applying means become too dense but also a problem that the width of the flexible cable must be increased in order to accommodate these patterns.

Thus, an appropriate solution is to divide the nozzle openings into a plurality of groups and allocate a single semiconductor integrated device to each group. However, in this case, conductive path patterns that at least supply power to transmit a print signal to the semiconductor devices from one side to the other side of the flexible cable and to drive these integrated devices are necessary. Therefore, these patterns must be formed so as to make a detour around the windows that allow the integrated devices to be attached to the flexible cable. This requires a reduced width of a wiring pattern, which in turn imposes the problem of impaired reliability, etc.

In order to overcome this problem, it is conceivable to divide the nozzle openings into a plurality of groups and supply a signal every group with a flexible cable dedicated to each group. This, in turn, imposes the problem of difficult cabling, etc.

SUMMARY OF THE INVENTION

The present invention has been made in view of the aforementioned circumstances. The object of the present invention is therefore to provide an ink jet recording head capable of supplying drive signals to a plurality of head units by a single flexible cable without decreasing the width of a conductive pattern and increasing the width of a flexible cable.

In order to achieve the above and other objects, the present invention is applied to an ink jet recording head that includes a plurality of recording head units and a flexible cable. Each of the plurality of recording head units has a pressure producing chamber communicating with a nozzle opening, a pressure producing means for applying pressure to the pressure producing chamber, and a connecting terminal for supplying a drive signal to the pressure producing means. The plurality of recording head units are arranged linearly. The flexible cable has a drive signal generating semiconductor device that generates a drive signal for driving the pressure producing means based on a print signal from an external source, supplies the print signal from an external drive circuit to the drive signal generating semiconductor device, and supplies the drive signal generated by the drive signal generating semiconductor device to the pressure producing means while connected to the connecting terminal. In such ink jet recording head, the flexible cable has a widow and a conductive path, the window allowing the drive signal generating semiconductor device to be attached thereto, and the conductive path being formed so as to extend substantially in parallel in a direction of arrangement of the recording head units and being exposed at a window region in such a manner that a metal foil forming the conductive path traverses the window and suspends on the lower surface of the semiconductor device.

DETAILED DESCRIPTION OF THE PREFERRED EMBODIMENTS

Figure 1:
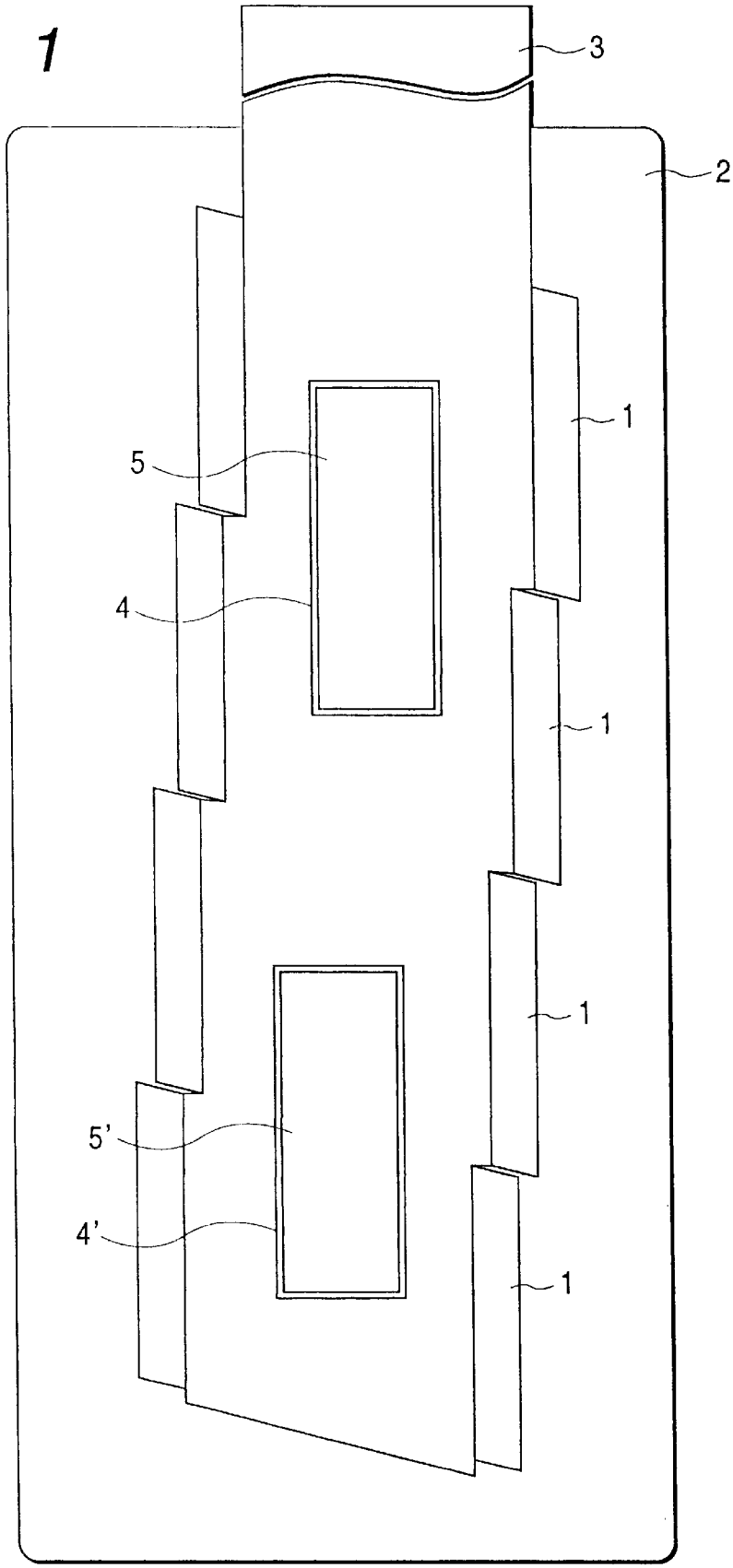
FIG. 1 shows an embodiment of the present invention.

Details of the present invention will now be described with reference to the embodiments shown in the drawings.

Figure 2:
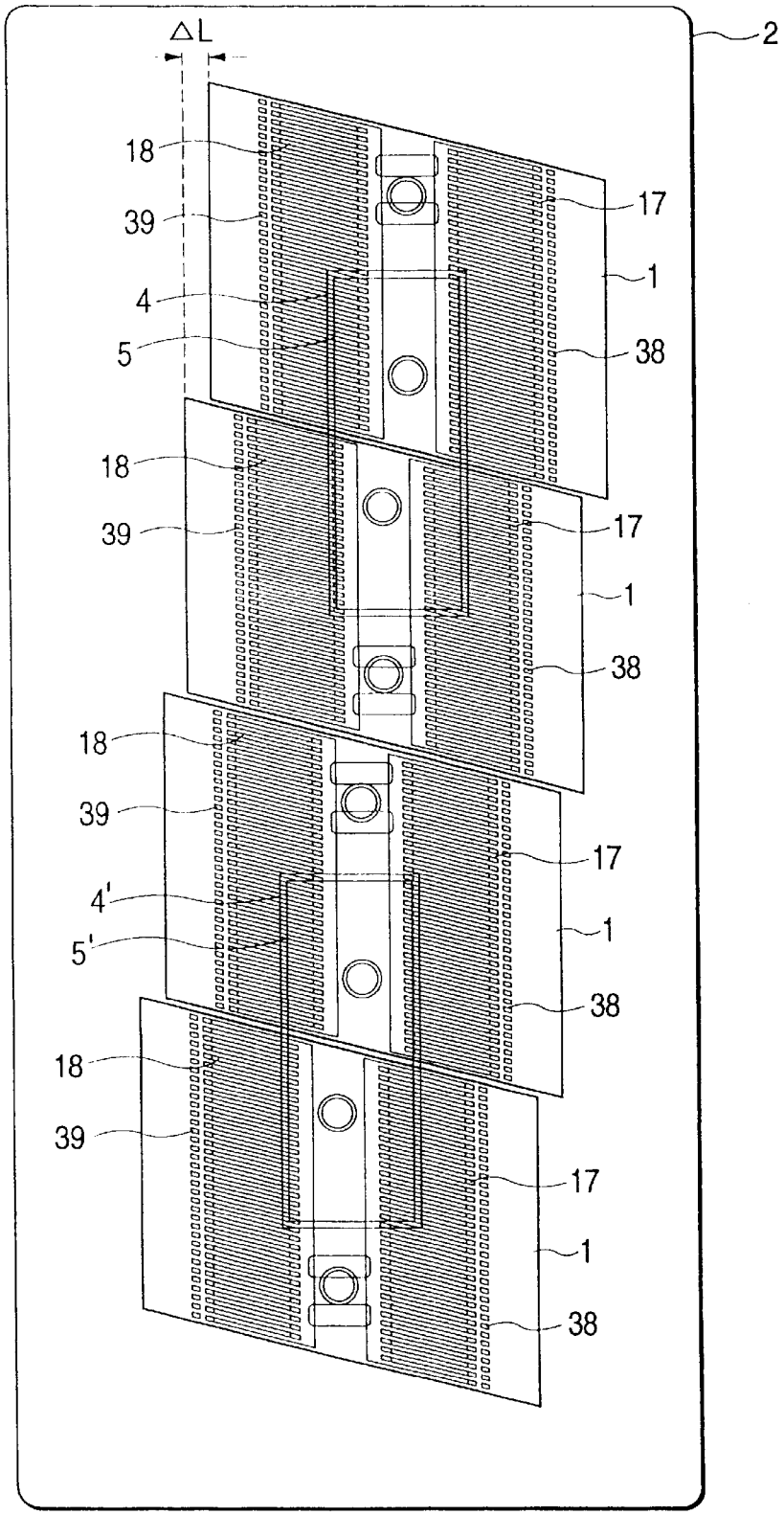
FIG. 2 shows the embodiment of the present invention with a flexible cable removed.

FIGS. 1 and 2 show an embodiment of the present invention. In FIGS. 1 and 2, reference numerals 1, 1, 1, 1 denote recording head units, which are formed so as to have the same structure and fixed to a fixing board while distanced at a predetermined distance ΔL from each other. The fixing board is a nozzle plate 2 in this embodiment.

These recording head units 1, 1, 1, 1 are connected through a single flexible cable 3. The flexible cable 3 has a window 4, and a drive signal generating semiconductor integrated device 5 is fixed to the window 4 (two devices 5, 5' are fixed to the windows 4, 4' in this embodiment). The drive sinal generating semiconductor integrated device converts a print signal into a drive signal.

As a result of this construction, when an end of the flexible cable 3 is connected to an external drive circuit (not shown), the semiconductor integrated circuits 5, 5' that have received a print signal and a drive voltage can generate a drive signal for jetting an ink droplet out of each recording head unit.

Figure 3A:
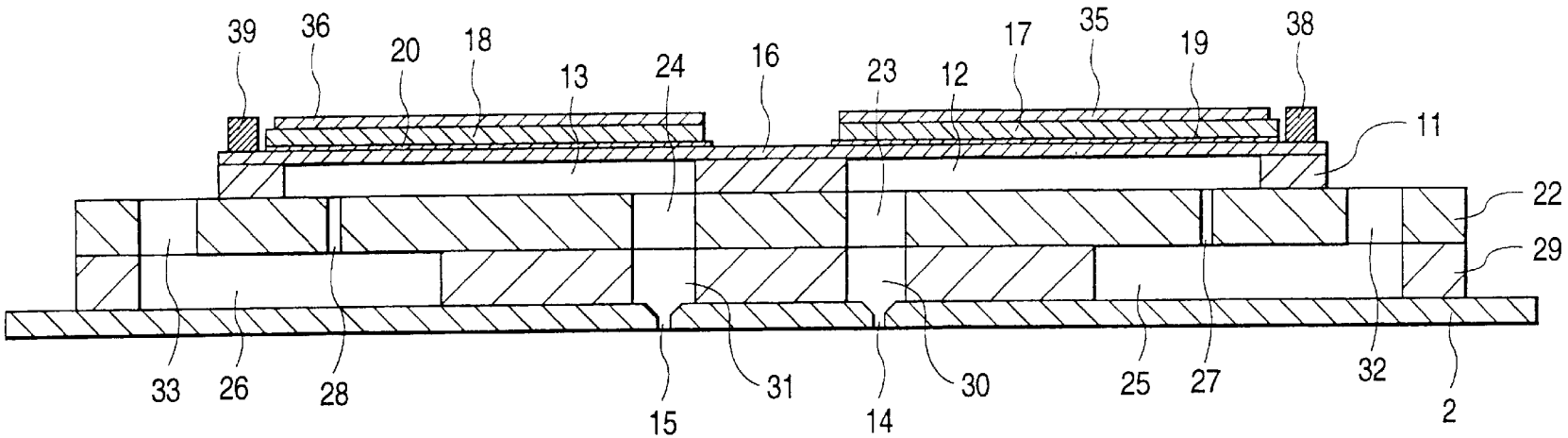
FIGS. 3(*a*) and 3(*b*) show an embodiment of a recording head unit that constitutes an ink jet recording head of the present invention in the form of a sectional structure in the vicinity of pressure producing chambers.
Figure 3B:
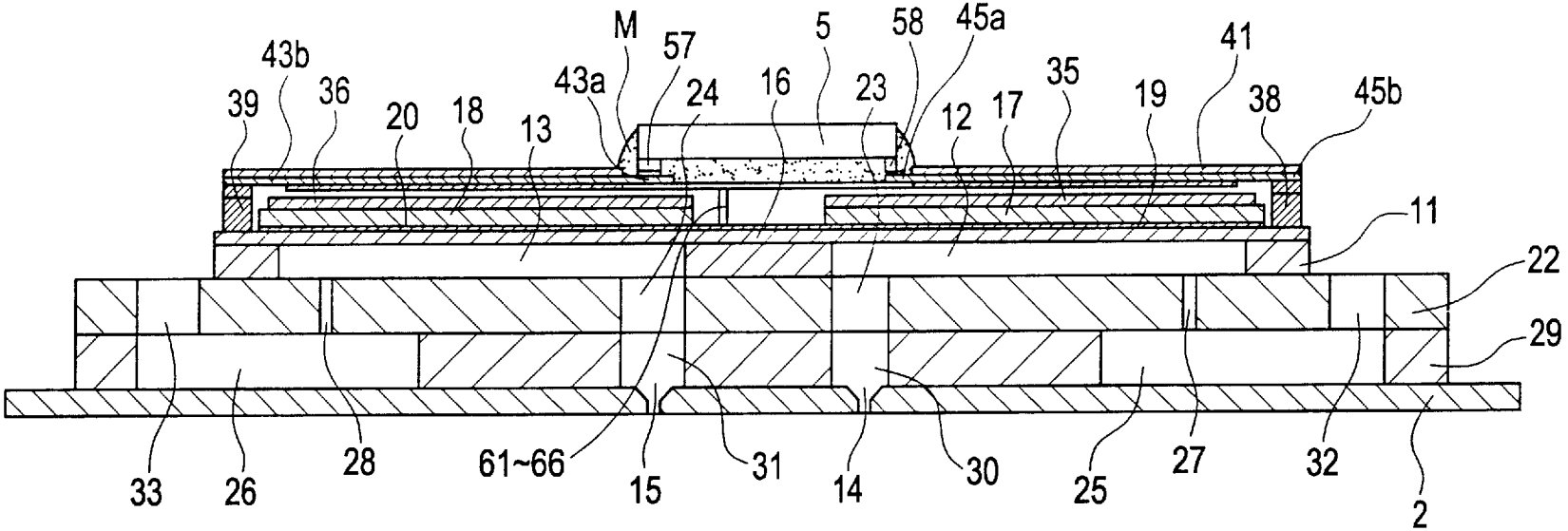
Figure 4:
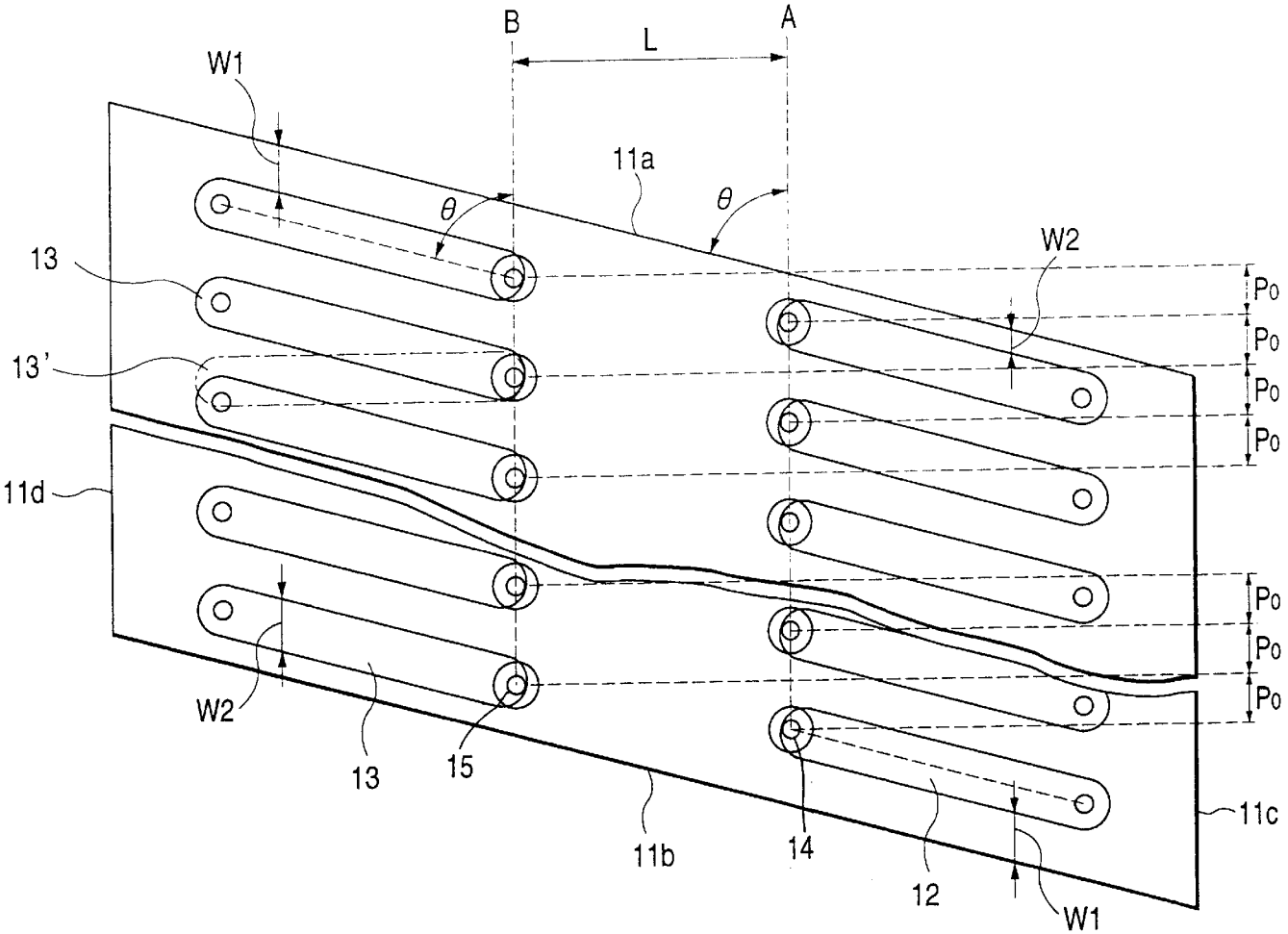
FIG. 4 shows the embodiment of the recording head unit that constitutes the ink jet recording head of the present invention with a vibrating plate removed.

FIGS. 3(*a*) and 3(*b*) an embodiment of each recording head unit in the form of a sectional structure taken along the length of pressure producing chambers 12, 13; and FIG. 4 is a diagram showing a layout of the pressure producing chambers with a vibrating plate 16 (to be described later) on the top of the pressure producing chambers removed. Reference numeral 11 denotes a spacer. The spacer 11 has the pressure producing chambers 12, 13 formed in a board that is made of a ceramic plate such as a zirconia (ZrO2) plate having such a thickness as to suitably form the pressure producing chambers 12, 13 whose depth is about 150 μm. The pressure producing chambers 12, 13 are arranged in such a manner that the axial line thereof forms an acute angle θ with respect to the direction of arrangement of nozzle openings 14, 15.

Further, outer walls 11*a*, 11*b* adjacent to pressure producing chambers 12, 13 on both ends are formed so as to extend substantially in parallel to the axial line of each of the pressure producing chambers 12, 13, whereas outer walls 11*c*, 11*d* in the other direction (in the vertical direction as viewed in FIG. 4) are formed so as to extend substantially in parallel to the lines of arrangement A, B of the nozzle openings 14, 15. The outer walls 11*a*, 11*b* defining the pressure producing chambers 12, 13 are formed so that the thicknesses thereof W1, W2 are as thin as possible.

By arranging the pressure producing chambers 12, 13 in such a manner that the axial line thereof forms an acute angle θ with respect to the lines of arrangement of the nozzle openings 14, 15, the length of each pressure producing chamber is increased compared with that of a conventional pressure producing chamber (denoted by reference numeral 13' in FIG. 4) whose axial line forms a right angle with respect to the line of arrangement of the nozzle openings. This leads especially advantageous in that the volume of a pressure producing chamber necessary for jetting an ink droplet can be ensured satisfactorily even if the width of each pressure producing chamber must be reduced to achieve higher integration.

Reference numeral 16 denotes the vibrating plate, which provides a sufficient bonding force when baked integrally with the spacer 11 and which is formed of a material that can be elastically deformed by flexural vibrations produced by piezoelectric vibrators 17, 18 . . . that will be described later. For example, a thin zirconia plate whose thickness is 7 μm is used as the vibrating plate.

Reference numerals 17, 18 . . . denote the piezoelectric vibrators, which are formed by sintering a green sheet of a piezoelectric material on the surface of lower electrodes 19, 20 that are formed on the surface of the vibrating plate 16.

FIGS. 3(*a*) and 3(*b*) reference numeral 22 denotes a cover plate that is integrally bonded to the other surface of the spacer 11. In this embodiment the cover plate 22 is made of a thin zirconia plate whose thickness is 100 μm, and has through holes 23, 24 that connect the nozzle openings 14, 15 of the nozzle plate 2 to the pressure producing chambers 12, 13 and through holes 27, 28 that connect reservoirs 25, 26 to be described later to the pressure producing chambers 12, 13.

Reference numeral 29 denotes an ink supply passage forming plate, which is made of a corrosion-resistant plate member suitable for forming ink passages such as a stainless steel whose thickness is 150 μm and which has through holes that serve as the reservoirs 25, 26 and through holes 30, 31 that connect the pressure producing chambers 12, 13 to the nozzle openings 14, 15.

The reservoirs 25, 26 have ink supplied from an external ink tank while communicating with ink supply ports 32, 33 arranged in the cover plate 22, and supply the ink to the pressure producing chambers 12, 13 through the through holes 27, 28.

Those members 11, 16, 22 formed of ceramics out of these members 11, 16, 22, 29 are grouped into a single body by baking, and the member 29 made of metal or the like is fixed to the single body by a method suitable for bonding to ceramics, so that the aforementioned recording head unit 1 is assembled.

Further, upper electrodes 35, 36 are formed on the surface of the piezoelectric vibrators 17, 18. The upper electrodes 35, 36 are formed so as to extend substantially in parallel to the piezoelectric vibrators 17, 18 and introduced to connecting terminal portions 38, 39 that are to be connected to the flexible cable 3.

Figure 5:
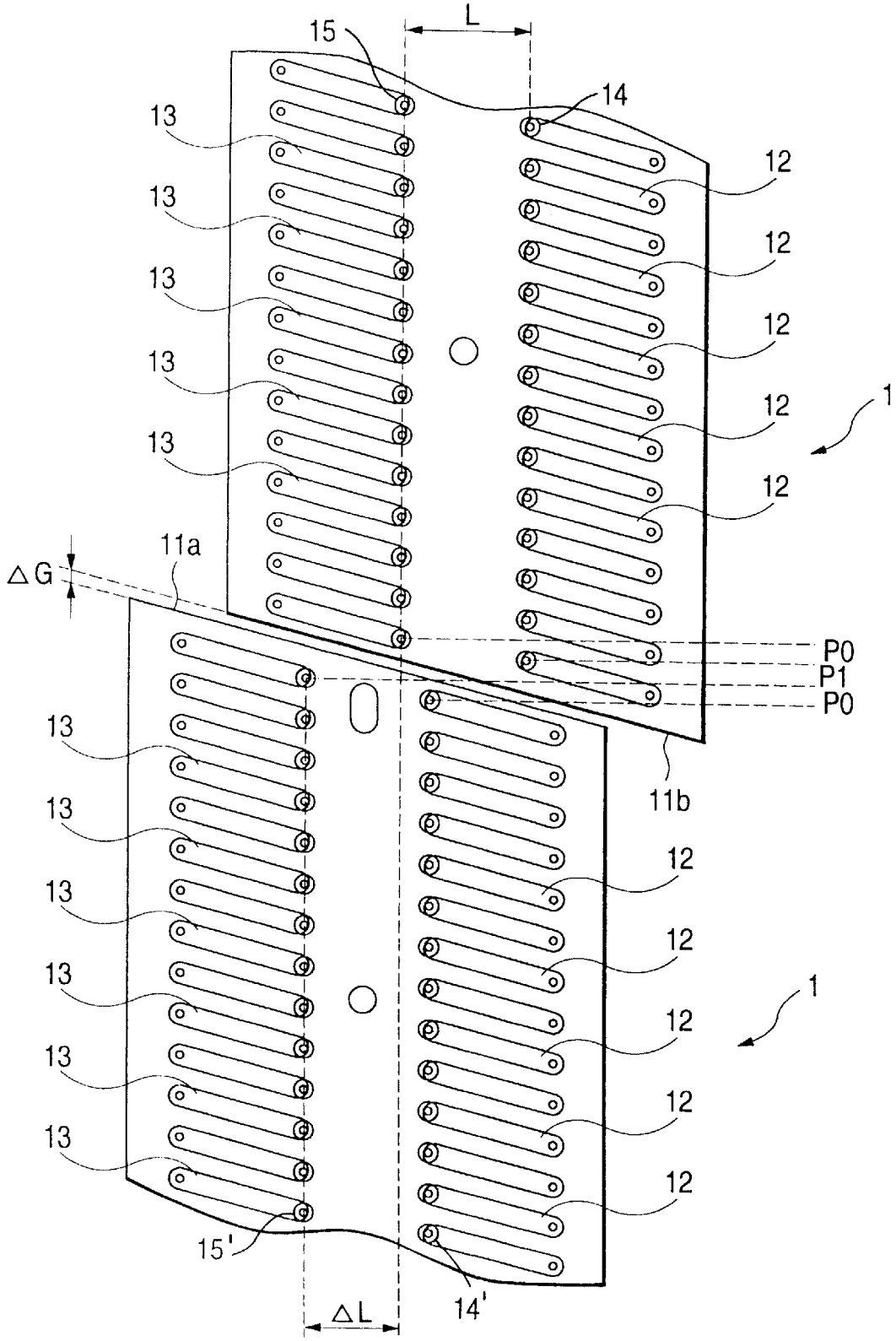
FIG. 5 shows a positional relationship between two adjacent recording head units.

Reference numeral 2 denotes the aforementioned nozzle plate. In this embodiment the nozzle plate 2 serves also as the fixing board of the head unit 1. As shown in FIG. 5, a set of nozzle openings 14, 15 and a set of nozzle openings 14', 15' respectively connected to the recording head units 1, 1 that are adjacent to each other are arranged in such a manner that a predetermined distance L is provided between a line of nozzle openings 14 and a line of nozzle openings 15 and between a line of nozzle openings 14' and a line of nozzle openings 15'. Further the line of nozzle openings 14 is shifted by a distance ΔL from the line of nozzle openings 14', these lines of nozzle openings 14, 14' being adjacent to each other, and the line of nozzle openings 15 is also shifted by a distance ΔL from the line of nozzle openings 15', the lines of nozzle openings 15, 15' being adjacent to each other. The lines of nozzle openings are shifted in a scanning direction of the head, i.e., in a head moving direction.

A plurality of the thus constructed recording head units 1, four in this embodiment, are fixed to the nozzle plate 2 in the following way. The outer walls 11*a*, 11*b* of the head units 1 extend in parallel to each other and the head units 1 are positioned by the distance ΔL from each other so that the shortest distance P1 between the outermost nozzle opening of one head unit 1 and the outermost nozzle opening of the other head unit adjacent thereto coincides with a pitch P0 between the nozzle openings 14 and 15 and between the nozzle openings 14' and 15' which is an original nozzle opening pitch of the head unit.

Even if a gap ΔG must be provided taking into account the fixing of the head units 1 to the fixing board, the adjacent recording head units 1, 1 can be fixed to the nozzle plate 2 with the nozzle opening pitch P1 between the recording head units 1, 1 coinciding with the pitch P0 by slightly increasing the distance ΔL.

Figure 6:
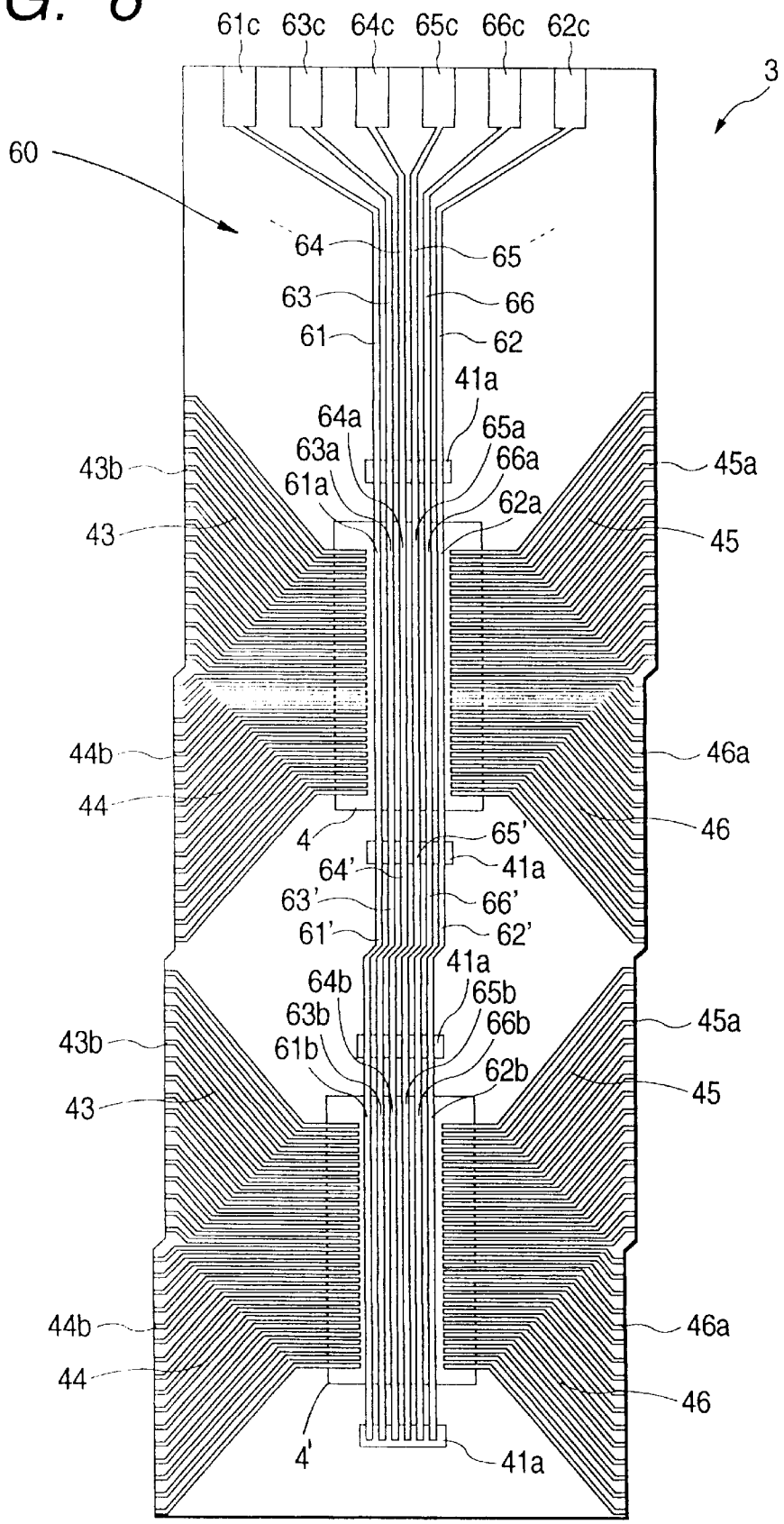
FIG. 6 shows an embodiment of the flexible cable.
Figure 7:
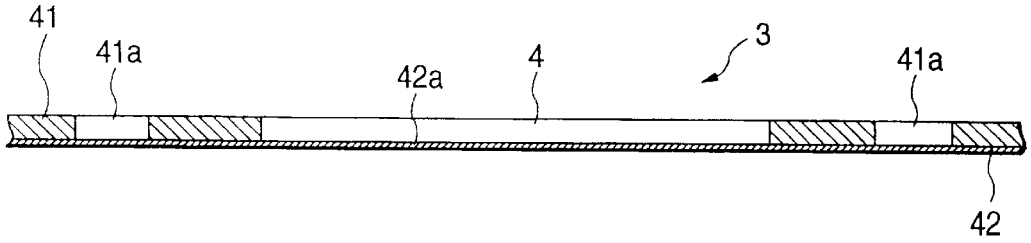
FIG. 7 is a sectional view showing a sectional structure of the flexible cable.

FIG. 6 shows an embodiment of the flexible cable 3 that supplies drive signals to the plurality of recording head units. The flexible cable 3 has a length long enough to cover the plurality of recording head units 1, 1, 1, 1 constituting the recording head, and a width wide enough to allow the ends across the width of the flexible cable 3 to come in contact with the connecting terminals 38, 39 of the recording head units 1, 1, 1, 1. The flexible cable 3 is formed not only by arranging a plurality of windows 4 in a heat-resistant electrically insulating film 41 (FIG. 7) such as a polyimide film, but also by bonding a metal foil 42 such as a copper foil. The windows 4 allow the drive signal generating semiconductor integrated devices 5, 5' to be attached to the flexible cable 3. The film 41 is so shaped as to allow the lines of arrangement of the connecting terminals 38, 39 of each recording head unit to define the outer ends thereof. Further, windows 41*a*, 41*a*, . . . are formed close to the short sides of each window 4. Each window 41*a* allows heating means to be inserted thereinto. The heating means is employed to directly heat the metal foil 42 when at least a path serving as a ground line out of conductive paths 61 to 66 (to be described later) is directly soldered either to the lower electrodes 19, 20 or to connecting electrodes of each recording head unit 1 by separating part of the heat-resistant electrically insulating film 41.

Each of these windows 4, 4' is slightly larger in size than the outer periphery of the semiconductor integrated device 5 and is formed as a through hole having such a size as to ensure a gap for forming tabs 43*a*, 43*a*, . . . , 44*a*, 44*a*, . . . , 45*a*, 45*a* . . . , 46*a*, 46*a* . . . (FIG. 9), each tab having a length long enough to be connected to output terminals 57, 57, . . . , 58, 58 . . . (FIGS. 8(*a*) and 8(*b*)) formed on the long sides of the semiconductor integrated device 5.

On the other hand, a wiring pattern 60 is formed over the middle area as viewed in the axial direction of the flexible cable 3. The wiring pattern 60 includes a print signal line, a drive voltage supply line, a ground line, and the like having the conductive paths 61, 62, 63, 64, 65, 66. The conductive paths 61 to 66 forming the wiring pattern 60 are made of a copper foil having, e.g., a thickness of about 35 μm and a width of about 50 μm.

The metal foil 42 constituting the conductive paths 61 to 66 is exposed while left directly extended to the wiring pattern 60 regions around the short sides of the windows 4, 4', so that conductive paths 61*a*, 62*a*, 63*a*, 64*a*, 65*a*, 66*a* are formed. The conductive paths 61*a* to 66*a* extend so as to be connected to similar conductive paths 61 to 66 formed on the opposite end with the windows 4, 4' interposed therebetween. Since there is no semiconductor integrated device downstream of the second window 4' in this embodiment, requirements for forming the wiring pattern 60 in the window 4' region are such that the conductive paths be connected only to the signal input terminals of the second semiconductor integrated device 5'. Therefore, the window 4' region can be used to form the tabs 61*b*, 62*b*, 63*b*, 64*b*, 65*b*, 66*b*.

Further, the aforementioned tabs 43*a*, 43*a* . . . , 44*a*, 44*a* . . . , 45*a*, 45*a* . . . , 46*a*, 46*a* . . . that can be connected to the connecting terminals 57, 57, 57, .. . , 58, 58, 58 . . . of the semiconductor integrated devices 5, 5' are formed along the adjacent long sides of the windows 4, 4', and these tabs are connected to connecting terminal portions 43*b*, 43*b*, . . . , 44*b*, 44*b* . . . , 45*b*, 45*b*, . .. , 46*b*, 46*b* . . . that are formed at the same pitch as the connecting terminals 38, 39 of each recording head unit 1 through drive signal supply wiring patterns 43, 43, . . . , 44, 44, . . . , 45, 45 . . . , 46, 46, . . .

Figure 8A:
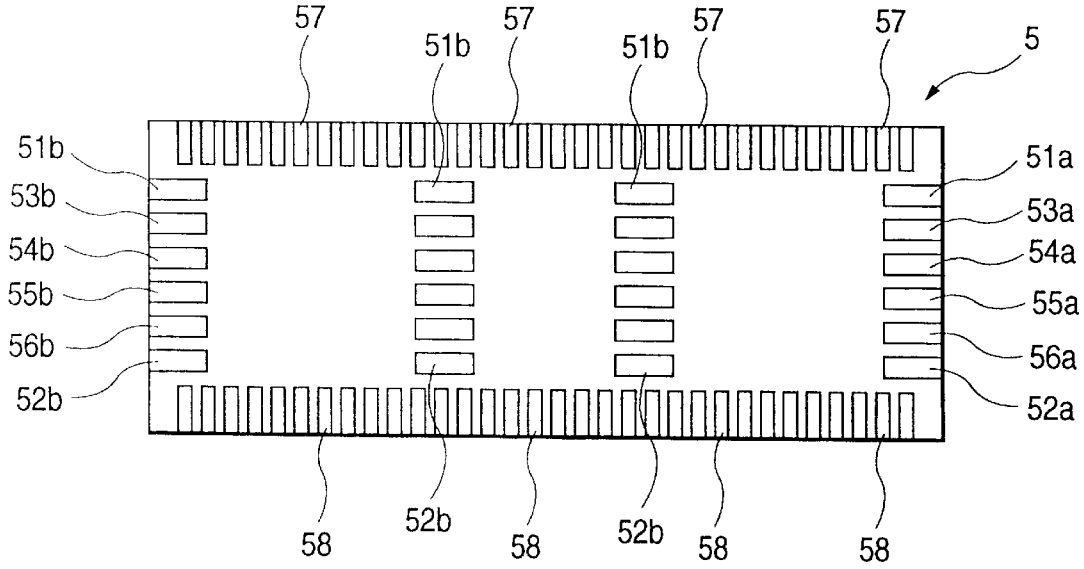
FIGS. 8(*a*) and 8(*b*) show a terminal structure of a drive signal generating semiconductor integrated device.
Figure 8B:
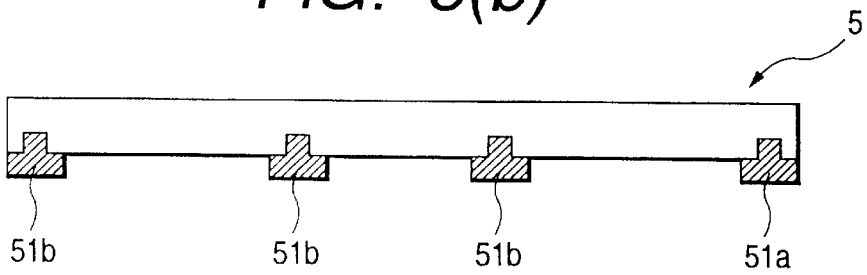

On the other hand, the semiconductor integrated device 5 has, as shown in FIG. 8, the drive signal output terminals 57, 57 . . . , 58, 58, . . . formed at the edge portions along the long sides thereof, and signal input terminals 51*a*, 52*a*, 53*a*, 54*a*, 55*a*, 56*a* for print signals and drive signals formed along the short sides thereof, and further has a plurality of junction terminals 51*b*, 51*b* . . . to 56*b*, 56*b* . . . formed so as to extend in parallel to the long sides thereof. If some of these junction terminals 51*b*, 51*b* . . . to 56*b*, 56*b* . . . are formed as signal terminals similarly to the signal input terminals 51*a*, 52*a*, 53*a*, 54*a*, 55*a*, 56*a* as the case may so require, then signals can be supplied from a plurality of sources, which in turn contributes to improving reliability.

Further, signals and the like that are normally to be transmitted by the wiring pattern within the semiconductor integrated device can be distributed to predetermined points within the semiconductor integrated device through the wiring pattern 60 and the junction terminals 51*b* to 56*b*, the wiring pattern 60 being formed on an external place and having a larger sectional area than the wiring pattern in the semiconductor device. Therefore, it is only a minimally required wiring pattern that must be formed in the semiconductor integrated device, which in turn contributes to downsizing the semiconductor integrated device 5.

Figure 9:
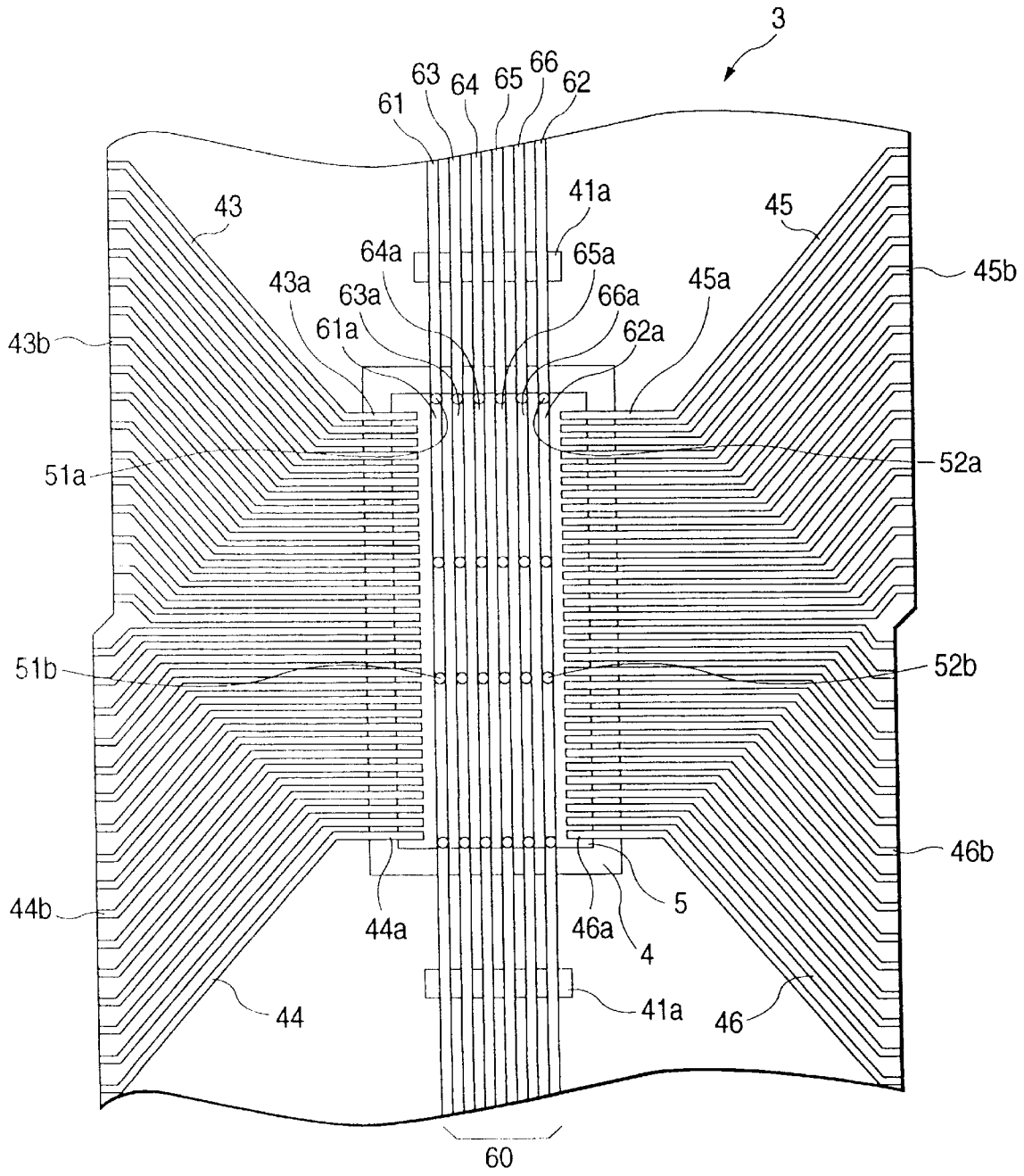
FIG. 9 is a plan view showing a structure close to a window of the flexible cable in enlarged form.
Figure 10:
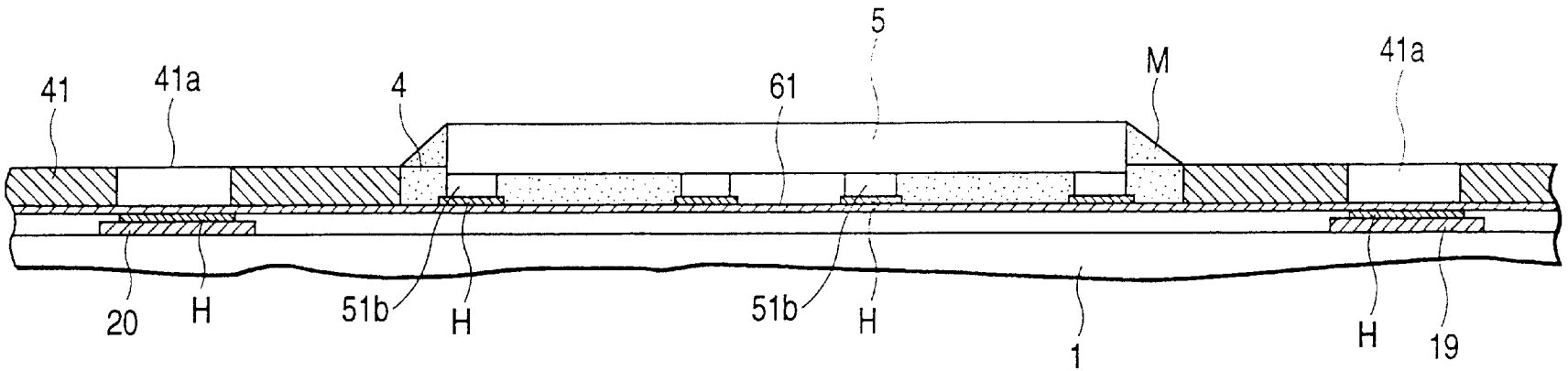
FIG. 10 is a sectional view showing a structure close to the window of the flexible cable in enlarged form.

While setting the semiconductor integrated devices 5, 5' to such predetermined positions of the windows 4, 4' of the thus constructed flexible cable 3 as shown in FIGS. 9 and 10, the semiconductor integrated devices 5, 5' are connected and fixed to the flexible cable 3 by fixing the tabs to the terminals through a solder layer H in the following way. The tabs 43*a*, 43*a* . . . , 44*a*, 44*a* . . . , 45*a*, 45*a* . . . , 46*a*, 46*a* . . . along the long sides are fixed to the terminals 57, 57 . . . 58, 58, . . . of the semiconductor integrated devices 5, 5'; the conductive paths 61*a* to 66*a* of the first window 4 that are exposed to the short sides are fixed to the signal input terminals 51*a*, 52*a*, 53*a*, 54*a*, 55*a*, 56*a* and junction terminals 51*b*, 51*b* . . . to 56*b*, 56*b* . . . of the semiconductor integrated devices 5, 5'; and further the tabs 61b to 66b of the second window 4' are fixed. As a result, the conductive paths 61*a* to 66*a* exposed from the window 4 are supported in suspension by the signal input terminals 51*a*, 52*a*, 53*a*, 54*a*, 55*a*, 56*a* and the junction terminals 51*b*, 51*b* . . . to 56*b*, 56*b* . . . of the semiconductor integrated device 5.

Then, at least the conductive paths 61*a* to 66*a* exposed from the peripheral edges of the semiconductor integrated device 5 and the window 4 are molded with a molding material M, and the flexible cable 3 is fixed to the semiconductor integrated circuit 5 and the conductive paths 61*a* to 66*a* are insulated.

Further, at least a conductive path that will serve as a ground line out of the conductive paths 61 to 66 is fixed to the lower electrodes 19, 20 of the recording head unit 1 or to the connecting electrodes arranged on the lower electrodes 19, 20 through the window 41*a*. Such conductive path is connected through a solder layer H.

The flexible cable 3 to which the semiconductor integrated devices 5, 5' have been fixed is positioned in such a manner that the fixed regions of the respective semiconductor integrated devices 5, 5' spread over two head units 1, 1 and that the connecting terminal portions 43*b*, 43*b*, . . . , 44*b*, 44*b* . . . , 45*b*, 45*b*, . . . , 46*b*, 46*b* . . . on both sides confront the connecting terminals 38, 39 of the respective units 1, 1. Then, the connecting terminals 38, 39 are soldered to the connecting terminal portions 43*b*, 43*b*.

In this embodiment, when a print signal and drive voltages are applied to external drive circuit connecting terminals 61*c* to 66*c*, drive signals and the drive voltages are delivered to the first drive signal generating semiconductor integrated device 5 through the conductive paths 61 to 66 of the flexible cable 3. These drive signals and drive voltages are supplied to conductive paths 61' to 66' between the first window 4 and the second window 4' via the conductive paths 61*a* to 66*a* exposed from the first window 4, and also received by the second semiconductor integrated device 5' from the tabs 61*b* to 66*b*.

The respective semiconductor integrated devices 5, 5' generate drive signals for the recording head units 1, 1, 1, 1 based on a print signal. These drive signals are applied to the piezoelectric vibrators 17, 18 of the recording head units 1, 1, 1, 1 through the terminals 57, 58, of the semiconductor integrated devices 5, 5' the tabs 43*a* to 46*a* and the drive signal supply wiring patterns 43 to 46, so that the pressure producing chambers 12, 13 corresponding to the print signal are expanded and contracted to thereby jet ink droplets out of the nozzle openings 14, 15.

While an example in which a plurality of recording head units that expand and contract the pressure producing chambers by flexural vibrations of the piezoelectric vibratos are used has been described in the aforementioned embodiment, it is apparent that the present invention may be applied to a bubble jet recording head that is rectangular and allows other recording heads to be arranged adjacent to two diametrically opposed sides.

Further, while an example in which four head units are used to constitute a recording head has been described in the aforementioned embodiment, it is apparent that a recording head can be formed by arranging two heads or more.

Still further, while the nozzle plate is used as the fixing board in the aforementioned embodiment, it is apparent that similar advantages can be provided by arranging a plurality of head units and mounting such head units on a fixing board, each head unit having a nozzle plate on itself so that ink droplets can be jetted by the head unit itself.

As described in the foregoing, in the present invention windows and conductive paths are formed in a flexible cable that is connected to recording head units. That is, the windows allow drive signal generating semiconductor devices to be attached to the cable, and the conductive paths are formed not only in such a manner as to extend substantially in parallel to one another in a direction of arrangement of the recording head units, but also in such a manner as to have a metal foil exposed at window regions so that the metal foil traverses the windows and is suspended on the lower surfaces of the semiconductor devices, the metal foil forming the conductive paths. Therefore, the conductive paths that transmit a print signal can be formed in the middle of the flexible cable without making a roundabout course or reducing the width thereof independently of the presence of the windows, and a structure around the recording head can be simplified by allowing a plurality of recording head units to be driven with a single flexible cable.

What is claimed is:

1. A head for a printing apparatus, the head comprising:

at least one recording head unit having (1) pressure producing means for ejecting an ink, and (2) a connecting terminal for supplying a drive signal to the pressure producing means; and a flexible cable having (1) a conductive path, and (2) a drive signal generating semiconductor device for generating the drive signal to drive the pressure producing means based on a print signal from the conductive path, wherein the conductive path traverses across the drive signal generating semiconductor device.

2. The head for the printing apparatus according to, claim 1, wherein the drive signal generating semiconductor device has a junction terminal that supports the conductive path.

3. The head for the printing apparatus according to claim 2, wherein at least a part of the junction terminal is electrically connected to the drive signal generating semiconductor device.

4. The head for the printing apparatus according to claim 1, further comprising:

a plurality of drive signal generating semiconductor devices;

wherein the flexible cable has a plurality of windows for receiving the respective drive signal generating semiconductor devices.

5. The head for the printing apparatus according to claim 1, wherein the flexible cable further includes a window receiving the drive signal generating semiconductor device, and the conductive path traverses the window.

6. The head for the printing apparatus according to claim 5, wherein the flexible cable includes a second window through which the conductive path is exposed.

7. The head for the printing apparatus according to claim 1, wherein the flexible cable further includes an output wiring pattern extending from the drive signal generating semiconductor device, the output wiring pattern is disposed substantially perpendicular to the conductive path.

8. The head for the printing apparatus according to claim 1, wherein each of the plurality of the recording head units has a nozzle opening through which the ink is ejected.

9. The head for the printing apparatus according to claim 1, wherein the plurality of recording head units are arranged linearly in an arrangement direction, and the conductive path extends substantially in parallel to the arrangement direction.

10. The head for the printing apparatus according to claim 1, wherein the drive signal generating semiconductor device has a plurality of signal input terminals electrically connected to the conductive path.

11. An ink jet recording head comprising:

at least one recording head unit having a plurality of nozzle openings, a pressure producing chamber communicating with the nozzle openings, pressure producing means for applying pressure to the pressure producing chamber, and a connecting terminal for supplying a drive signal to the pressure producing means; and a flexible cable having (1) a conductive path, and (2) a drive signal generating semiconductor device for generating the drive signal to drive the pressure producing means based on a print signal from the conductive path;

wherein the conductive path traverses across the drive signal generating semiconductor device.

12. The ink jet recording head according to claim 11, wherein the drive signal generating semiconductor device has a junction terminal that supports the conductive path.

13. The ink jet recording head according to claim 12, wherein at least a part of the junction terminal is electrically connected to the drive signal generating semiconductor device.

14. The ink jet recording head according to claim 11, wherein the flexible cable includes a second window through which the conductive path is exposed.

15. The ink jet recording head for the printing apparatus according to claim 11, further comprising:

a plurality of drive signal generating semiconductor devices;

wherein the flexible cable has a plurality of windows for receiving the respective drive signal generating semiconductor devices.

16. The ink jet recording head according to claim 11, wherein the plurality of recording head units are arranged linearly in an arrangement direction, and the conductive path extends substantially in parallel to the arrangement direction.

17. The ink jet recording head according to claim 11, wherein the drive signal generating semiconductor device has a plurality of signal input terminals electrically connected to the conductive path.

18. A flexible cable to which a semiconductor device is attachable, the flexible cable comprising:

an insulating film; and a conductive path provided on the insulating film;

wherein, when the semiconductor device is attached to the flexible cable, the conductive path traverses across the semiconductor device.

19. The flexible cable of claim 18, further comprising:

a window provided in the insulating film, the window adapted to receive the semiconductor device, wherein the conductive path traverses across the window.

20. The flexible cable of claim 19, further comprising:

a plurality of windows arranged in series in a longitudinal direction of the flexible cable.

21. The flexible cable of claim 19, further comprising:

an output wiring pattern provided on the insulating film, wherein, (1) when the semiconductor device is attached to the flexible cable, the output wiring pattern extends from the semiconductor device, and (2) the output wiring pattern is disposed substantially perpendicular to the conductive path.

22. The flexible cable of claim 19, wherein the flexible cable includes a second window through which the conductive path is exposed.

23. The flexible cable of claim 18, wherein, when the semiconductor device is attached to the flexible cable, the conductive path does not directly contact the semiconductor device.

24. The flexible cable of claim 23, wherein the semiconductor device has a junction terminal that supports the conductive path when the semiconductor device is attached to the flexible cable.

25. The flexible cable of claim 18, wherein the semiconductor device has a substantially rectangular shape including opposed short sides, and wherein, when the semiconductor device is attached to the flexible cable, the conductive path extends from one of the opposed short sides to the other one of the opposed short sides.

26. The flexible cable of claim 18, further comprising:

an output wiring pattern provided on the insulating film, wherein, (1) when the semiconductor device is attached to the flexible cable, the output wiring pattern extends from the semiconductor device, and (2) the output wiring pattern is disposed substantially perpendicular to the conductive path.

27. The flexible cable of claim 18, wherein the semiconductor device is attached to the flexible cable, the conductive path is electrically connected to a plurality of signal input terminals provided on the semiconductor device.

* * * * *